US005148803A

United States Patent [19]

Schlobohm

[11] Patent Number: 5,148,803

[45] Date of Patent: Sep. 22, 1992

[54] RESPIRATOR MASK WITH EASY-TO-CHANGE RESPIRATOR FILTER

[76] Inventor: Joachim Schlobohm, Salinenstrasse 7, D-2060 Bad Oldesloe, Fed. Rep. of Germany

[21] Appl. No.: 717,024

[22] Filed: Jun. 18, 1991

[30] Foreign Application Priority Data

Jun. 25, 1990 [DE] Fed. Rep. of Germany ..... 4020127

[51] Int. Cl.[5] ..... A62B 7/10

[52] U.S. Cl. ..... 128/205.27; 128/206.17

[58] Field of Search ..... 128/206.17, 205.27, 128/206.12, 206.21, 206.28, 201.25

[56] References Cited

U.S. PATENT DOCUMENTS 4,154,235 5/1979 Warncke ..... 128/201.25
4,467,795 8/1984 Eckstein ..... 128/206.17
4,473,072 9/1984 Walther ..... 128/206.12
4,562,837 1/1986 Schlobohm ..... 128/206.17

*Primary Examiner*—Edgar S. Burr
*Assistant Examiner*—Aaron J. Lewis
*Attorney, Agent, or Firm*—McGlew & Tuttle

[57] ABSTRACT

A respirator mask with a respirator filter and bellows sealing off the interior space of the mask against the surrounding atmosphere, which bellows surround the respirator filter at its end facing the interior space of the mask in the form of a rigid cuff, is to be improved such that replacement of the respirator filter will be simplified. To accomplish this task, the cuff (7) is continued in an elastic sleeve (8) nearly completely surrounding the respirator filter (2), and, with the sleeve (8) folded back, the respirator filter (2) can be inserted into or can be removed from the cuff (7).

9 Claims, 3 Drawing Sheets

RESPIRATOR MASK WITH EASY-TO-CHANGE RESPIRATOR FILTER

FIELD OF THE INVENTION

The present invention pertains to a respirator mask with a respirator filter on a respirator connection, and with bellows sealing off the interior space of the mask against the surrounding atmosphere. The bellows surround the respirator filter as a rigid cuff at its end facing the interior space of the mask.

BACKGROUND OF THE INVENTION

An escape respirator filter device with a respirator filter on the respirator connection, in which the respirator filter is connected to a mask body via bellows, has become known from West German Patent Specification No. DE-PS 32,36,028. The bellows seal off the interior space of the mask against the surrounding atmosphere and surround the respirator filter at the filter outlet in the form of a rigid cuff. Since the cuff has to assume holding and sealing functions at the same time, it is designed as a clip laid around the bellows. The respirator filter is arranged displaceably over the bellows in the mask body. A guide ring, whose diameter is such that the respirator filter can be pushed through with ease, is fastened on the mask body at the passage opening of the respirator filter. The bellows follow the axial displacement of the respirator filter. The stroke length is limited by the rigid cuff striking the guide ring.

It is a disadvantage of this prior-art escape respirator filter device that in order to change the respirator filter, the cuff must be taken apart by removing the clip from the bellows. This is time-consuming, because the removal must be performed in the poorly accessible interior space of the mask, and a tool is also needed to detach the clip.

West German Utility Patent No. DE-GM 67,52,895 discloses a respirator mask, which is made of an elastic plastic, and in the area of the respirator connection, it has a bellows-like projection, into which a respirator filter is inserted. Within the bellows-like projection, the respirator filter is fixed by a surrounding collar on the filter inlet and by a stop on the filter outlet.

It is a disadvantage of the prior-art device that it is difficult to remove the respirator filter from the bellows-like projection, because no dimensionally stable, cylindrical holder is provided at the filter outlet, and the bellows-like projection must be folded over the entire length of the filter when removing the respirator filter. In addition, there is no possibility of fixing a folded-over section of the bellows-like projection.

SUMMARY OF OBJECTS OF THE INVENTION

Therefore, the basic task of the present invention is to simplify the replacement of the respirator filter.

The task is accomplished according to the present invention by the rigid cuff being continued into an elastic sleeve nearly completely surrounding the respirator filter, wherein the respirator filter can be introduced into and/or removed from the cuff when the sleeve is folded back and is fixed in the folded-back position.

The advantage of the present invention is essentially the fact that a rigid, dimensionally stable cuff is provided for receiving the respirator filter, and the fixing function and the sealing function are taken over by the sleeve joining the cuff. Therefore, the cuff is able to come to lie in a loose fit on the respirator filter. The cylindrical part of the cuff surrounds the jacket surface of the respirator filter and extends over approximately half the respirator filter height, and is then continued in an elastic sleeve. The sleeve may be made from, e.g., natural rubber, neoprene, or silicone. To change the respirator filter, the sleeve is first folded back to the level of the rigid cuff, and is brought into contact with the outside of the cuff. Due to its intrinsic elasticity, the sleeve comes into firm contact with the cuff, and is fixed in this position. The respirator filter can now be removed. After changing the respirator filter, the sleeve is folded back, and it now comes into gas-tight contact around the jacket surface of the respirator filter. The respirator mask is now again ready to use. If the cuff is designed as a loose fit relative to the respirator filter, it is possible to provide rubber-elastic knobs, distributed over the circumference within the cuff, which fix the respirator filter in the cuff. The knobs prevent the respirator filter from dropping off during disassembly. In another advantageous embodiment, the sleeve consists of individual strip-shaped parts which extend in parallel to the respirator filter and are integrated in the shape of a ring at the filter inlet of the respirator filter. Reinforcements may be inserted into individual parts for stiffening. Beginning from the cuff, the sleeve may first be cylindrical, then extend in the form of strip-shaped parts, and then again cylindrical at the filter inlet. The cylindrical section following the cuff serves as a seal for the respirator filter. The strip-shaped parts make it easier to fold back the sleeve.

In another embodiment, the sleeve is designed as a rubber-elastic strip which surrounds the filter inlet of the respirator filter in the shape of a U, and whose legs are fastened on the cuff. The respirator filter is pushed by the U-shaped strip into the rigid cuff and fixed. To change the filter, the strip is peeled off to the side, and the respirator filter can be removed.

It is advantageous to provide the sleeve, at the level of the filter, with a collar, which surrounds the respirator filter and presses the respirator filter against the cuff in order to thus ensure firm fixation. If the sleeve consists of individual strip-shaped parts, the parts can be attached one by one to the collar on the respirator filter. The parts have such a length that they are first stretched during mounting and then fastened on the respirator filter under the elastic internal stress.

To facilitate mounting, it is advantageous to provide the collar with individual grasping tabs on the front side of filter inlet. By pulling the grasping tabs, the sleeve can be folded back in a particularly simple manner.

The grasping tabs may be provided with perforations or washboard-like stiffening members in order to provide a good contact surface and to prevent slipping off.

Inexpensive manufacture of the bellows and sleeve is achieved by designing these in one piece, in which case the sleeve is a continuation of the bellows, and the rigid cuff is formed by inserting a rigid band into the cylindrical projection of the bellows. This band may be vulcanized into the jacket surface or may be in contact with the inside. A rigid band in contact with the inside of the cuff can be mounted in a particularly simple manner and possesses particularly good sliding properties for the respirator filter to be introduced.

The respirator filter with the sleeve can be pushed into the mask body along a guide ring in the mask connection, and the length of displacement is determined by the length of the bellows. By pushing the respirator filter into the interior space of the mask, the smallest possible installation height is reached.

It is advantageous to provide the cuff at the filter outlet with a stop, against which the respirator filter can be pushed during introduction. It is particularly favorable in terms of cost to design the bellows, the sleeve, and the stop in one piece. The stop may be designed as a circumferential, bead- like lip.

To make it easier to push out the sleeve with the respirator filter inserted, it is advantageous to arrange between the sleeve and the guide ring a cylindrical sliding ring which improves the sliding properties on the surfaces in contact. In an advantageous embodiment, the sliding stamp is made of teflon and is pushed over the sleeve before the respirator filter is pushed in. However, it is also possible to coat the outer surface of the sleeve, or merely to provide on the sleeve strip-shaped areas which possess particularly good sliding properties together with the guide ring.

One embodiment of the present invention is shown in the drawing and will be described below.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
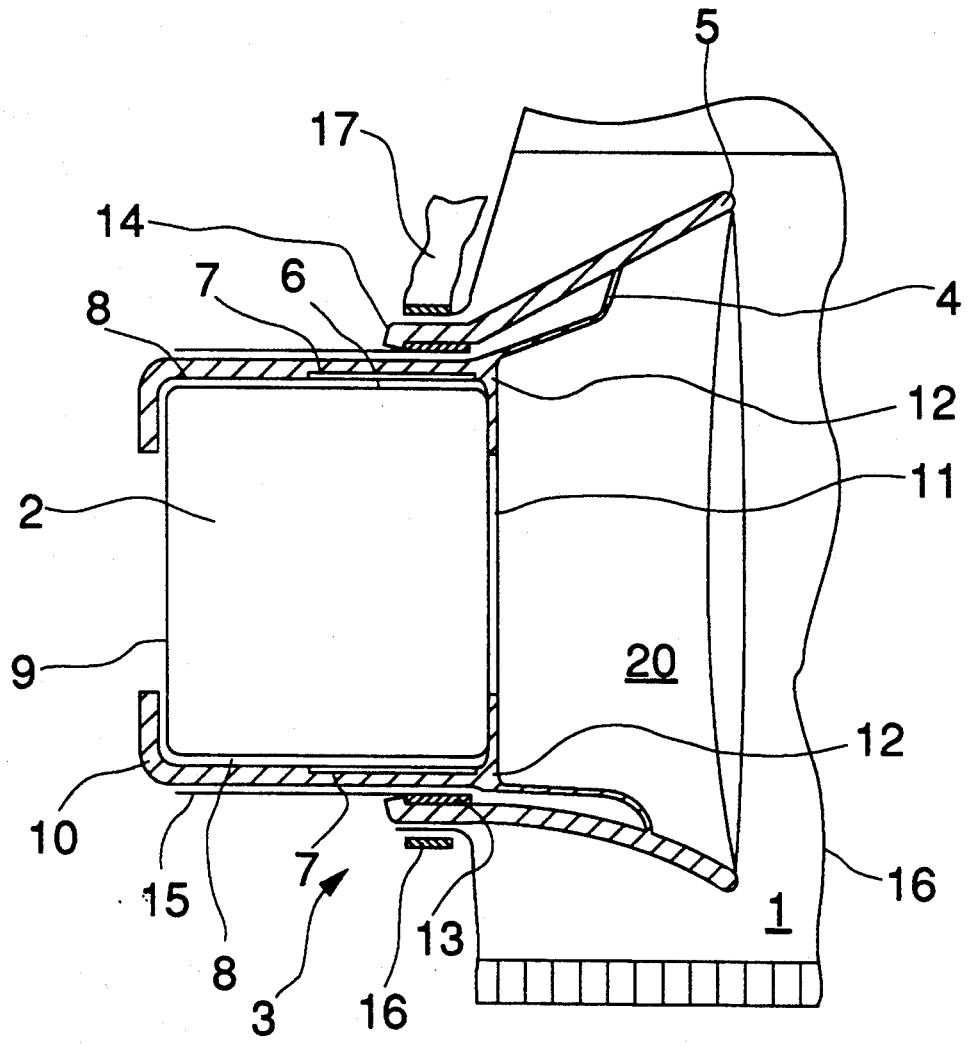
FIG. 1 is a respirator mask with the respirator filter pushed out.

FIG. 1 shows a respirator mask 1 with a respirator filter 2 on the respirator connection 3, which the filter 2 is fastened on bellows 4. The bellows 4 are part of the mask body 5 and seal the interior space 20 of the mask against the surrounding atmosphere. A rigid band 6, which, together with the bellows 4, forms a rigid cuff 7 for receiving the respirator filter 2, which is inserted between the bellows 4 and the respirator filter 2. The length of the cuff 7 extends over the length of the band 6. The cuff 7 is continued in an elastic sleeve 8, which surrounds the respirator filter 2 in a gas-tight manner. The respirator filter 2 abuts against a collar 10 at the filter inlet 9 and against a stop 12 at the filter outlet 11.

Stop 12, cuff 7, sleeve 8, and collar 10 are made in one piece with the bellows 4. A guide ring 13, by which the respirator filter 2 together with the sleeve 8 can be pushed into the interior space 20 of the mask, is provided in the respirator connection 3 between the sleeve 8 or the cuff 7 and the mask body 5.

When the respirator filter 2 is pushed out, the length of displacement is determined by the length of the bellows. The sealing lip 14 presses the outside of the cuff 7 on all sides and brings about fixation of the respirator filter 2 in the use position. Pushing out the respirator filter 2 into the use position is made easier if a sliding ring 15 is pushed over the sleeve 8 and the cuff 7. Particularly good sliding properties are obtained if the sliding ring 15 is made of teflon. A protective hood 16 and a band 17 are fastened on the respirator connection 3 with a clip 16, which is tensioned against the guide ring 13. The protective hood can be pulled over the head of a respirator user (not shown).

Figure 2:
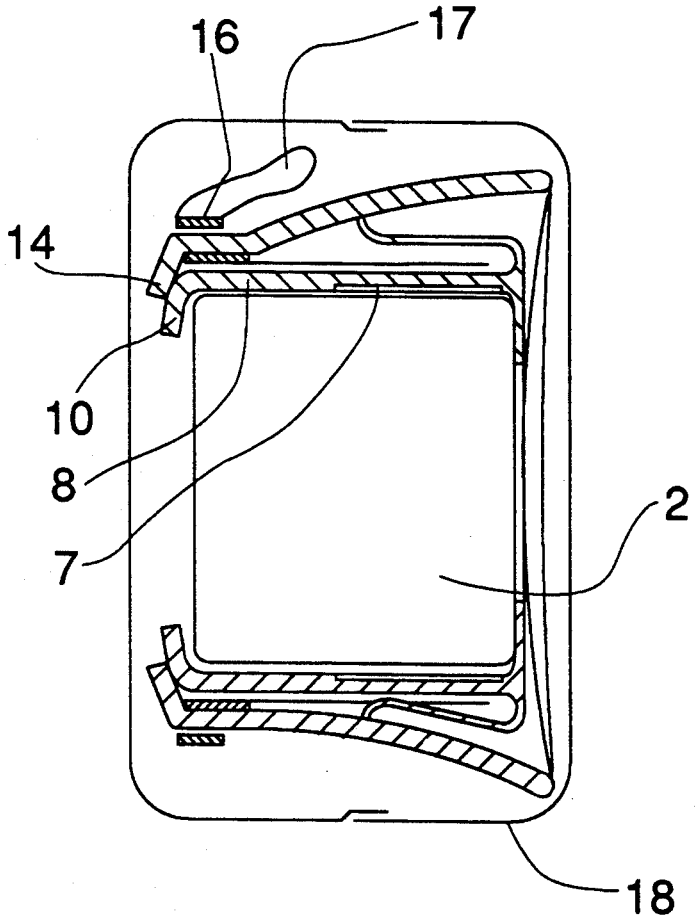
FIG. 2 is a respirator mask with the respirator filter pushed in the carrying container.

FIG. 2 shows the respirator mask 1 in a carrying container 18 with the respirator filter 2 pushed into the interior space 20 of the mask. In this transport position, the sealing lip 14 lies over the collar 10 and thus tensions the respirator filter 2 in the interior space 20 of the mask. The maximum length of insertion is limited by the length of the bellows 4.

Figure 3:
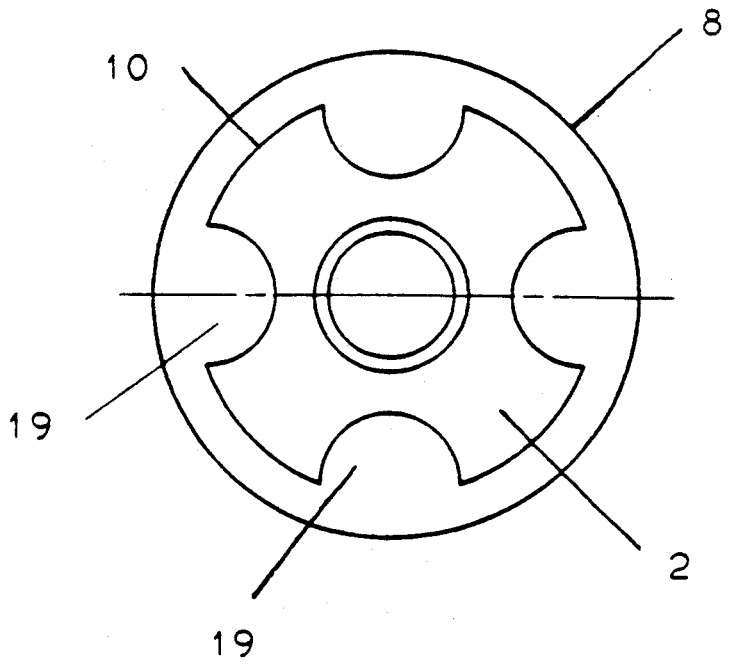
FIG. 3 is a front view of the respirator filter with sleeve.

FIG. 3 shows a front view of the respirator filter 2 with the sleeve 8 laid over it, the collar 10 surrounding the filter inlet 9, and the grasping tabs 19, which are arranged staggered through an angle of 90° and form a continuation of the collar 10.

To change the respirator filter 2, the sleeve 8 is first folded back to the level of the cuff 7, and laid over the outside of the cuff 7. To do so, the sleeve 8 is grasped by the grasping tab 19, and folded over the cuff 7. The respirator filter 2 can now be removed. During assembly, the new respirator filter is inserted into the cuff 7, and now it abuts against the stop 12. The sleeve 8 is then folded back again.

While a specific embodiment of the invention has been shown and described in detail to illustrate the application of the principles of the invention, it will be understood that the invention may be embodied otherwise without departing from such principles.

What is claimed is:

1. A respirator mask construction with a respirator filter, comprising: a mask body having a face engaging portion defining a space to engage around the nose and mouth of a person and having sealing lip, opposite said face engaging portion, for surrounding the respirator filter, a bellows sealing off an interior space of the mask against the surrounding atmosphere, said bellows extending inwardly of said mask body and being connected to a rigid cuff said rigid cuff surrounding the respirator filter at an end of said bellows facing the interior space of the mask, said cuff being connected to an elastic sleeve providing a continuation of said cuff surrounding the respirator filter, wherein the respirator filter can be inserted into or removed from the cuff when said elastic sleeve is folded back and fixed in a folded back position.

2. A respirator mask according to claim 1, wherein said sleeve is provided with a collar which is arranged on a filter inlet and surrounds the respirator filter.

3. A respirator mask according to claim 2, wherein said collar is provided with grasping tabs.

4. A respirator mask according to claim 1, wherein said bellows and said sleeve are formed integral in one piece and said cuff is designed as a rigid band connected with said bellows.

5. A respirator mask according to claim 1, wherein said respirator filter together with said sleeve can be pushed into a mask body of the mask along a guide ring provided in the respirator connection, the length of insertion of said filter with the sleeve into the mask body being determined by the length of said bellows.

6. A respirator mask according to claim 1, wherein said cuff is provided with a stop, positioned adjacent the interior space of said mask, said stop receiving said respirator filter for positioning said respirator filter.

7. A respirator mask according to claim 5, further comprising a sliding ring provided between said sleeve and said guide ring.

8. A respirator mask construction with a respirator filter, comprising: a respirator connection including a bellows sealing off an interior space of the mask against the surrounding atmosphere, said bellows being connected to a rigid cuff and surrounding the respirator filter at an end of said bellows facing the interior space of the mask, said cuff being connected to an elastic sleeve providing a continuation of said cuff surrounding the respirator filter, wherein the respirator filter can be inserted into or removed from the cuff when said elastic sleeve is folded back and fixed in a folded back position, said respirator filter together with said sleeve can be pushed into a mask body cf the mask along a guide ring provided in the respirator connection, the length of insertion of said filter with the sleeve into the mask body being determined by the length of said bellows.

9. A respirator mask construction with a respirator filter, comprising: a respirator connection including a bellows sealing off an interior space of the mask against the surrounding atmosphere, said bellows being connected to a rigid cuff and surrounding the respirator filter at an end of said bellows facing the interior space of the mask, said cuff being connected to an elastic sleeve providing a continuation of said cuff surrounding the respirator filter, wherein the respirator filter can be inserted into or removed from the cuff when said elastic sleeve is folded back and fixed in a folded back position, said cuff is provided with a stop, positioned adjacent the interior space of said mask, said stop receiving said respirator filter for positioning said respirator filter.

* * * * *